US005807524A

United States Patent [19]

Kelly et al.

[11] Patent Number: 5,807,524

[45] Date of Patent: Sep. 15, 1998

[54] PIPETTE TIP WITH PIPETTE SURFACE CONTAMINATION PROTECTOR

[75] Inventors: Christopher Kelly, Larkspur; James S. Petrek, Danville, both of Calif.

[73] Assignee: Rainin Instrument Co., Inc., Emeryville, Calif.

[21] Appl. No.: 692,770

[22] Filed: Aug. 6, 1996

[51] Int. Cl.[6] ..... B01L 3/02

[52] U.S. Cl. ..... 422/100; 422/99; 422/104; 73/864.01; 73/864.14

[58] Field of Search ..... 422/99, 100, 101, 422/103, 104; 73/864.01, 864.14

[56] References Cited

U.S. PATENT DOCUMENTS

| | | | |
|---|---|---|---|
| Re. 32,210 | 7/1986 | D'Autry | 73/864.14 |
| 3,464,800 | 9/1969 | Gerarde | 422/100 |
| 3,991,617 | 11/1976 | D'Autry | 73/864.14 |
| 4,007,639 | 2/1977 | Haeckel | 73/864.01 |
| 4,054,062 | 10/1977 | Branham | 73/864.14 |
| 4,275,591 | 6/1981 | Wand | 73/864.01 |
| 4,418,580 | 12/1983 | Satchell et al. | 73/864.13 |
| 4,806,313 | 2/1989 | Ebersole et al. | 422/100 |
| 4,873,059 | 10/1989 | Kido et al. | 422/100 |
| 4,933,148 | 6/1990 | Perlman | 422/100 |
| 5,192,511 | 3/1993 | Roach | 422/100 |
| 5,213,761 | 5/1993 | Sakagami | 422/63 |
| 5,232,669 | 8/1993 | Pardinas | 422/100 |
| 5,403,553 | 4/1995 | Heinonen | 422/100 |
| 5,435,197 | 7/1995 | Telimaa et al. | 73/864.14 |
| 5,509,319 | 4/1996 | Hitzman | 73/864.14 |

*Primary Examiner*—Harold Y. Pyon
*Attorney, Agent, or Firm*—Robert R. Meads

[57] ABSTRACT

A replaceable pipette tip comprising a pipette surface contamination protector comprising an upwardly extending projection connected by the shoulder to the proximal end portion for laterally spacing the pipette device from a tube which contains or which is to receive the sample fluid to prevent contamination of an outer surface of the pipette device by contact with the tube into which the pipette tip is inserted.

8 Claims, 3 Drawing Sheets

PIPETTE TIP WITH PIPETTE SURFACE CONTAMINATION PROTECTOR

BACKGROUND

The present invention relates to improvements in disposable pipette tips for pipette devices and, more particularly, to an improved pipette tip including a contamination protector for the outer surface of a pipette device to which the pipette tip is mounted.

Pipette devices for the transfer and dispensing the precise quantities of fluids in analytical systems are well known as is the use of disposable tips for such pipettes. Disposable tips accommodate serial use of pipette devices in the transfer of different fluids without carryover or contamination.

Generally speaking, disposable pipette tips are formed of plastic and are of an elongated conical shape with an open proximal end for receiving and releaseably mating with the end of a pipette tip mounting shaft of a pipette device. Ideally, the disposable tip should slide easily onto the mounting shaft to an axial position adjacent a tip ejection mechanism of the pipette device. Thus located, the pipette tip should be stable on the shaft, free from external rocking relative to the shaft (as during "touching off"), and form an air tight annular seal with the mounting shaft.

In some applications, it is desired to aspirate sample liquids from the bottom of narrow neck containers or small diameter tubes. Examples of such containers are centrifuge tubes where micro-volume pipette tips are utilized to aspirate very small sample volumes. As such a pipette tip is inserted into such a tube, the end of the pipette device to which the tip is mounted and the tip ejector mechanism of the pipette are moved adjacent to and often contact a sidewall of the tube. This results in the undesired transfer of fluids or other contaminates from the sidewall to an outer surface of the pipette, commonly the tip ejector mechanism. Such transfer can result in contamination of the tip ejector and cross contamination of subsequent samples if the tip ejector and outer surface of the pipette are not cleaned and/or sterilized before reuse.

One possible solution to this problem is to create pipette tips that are so long as to allow the tip to reach into such narrow neck containers and tubes and to aspirate liquid without an outer surface of the pipette device to which the tip is mounted contacting a sidewall of the tube and without the tip ejector mechanism entering the container. Unfortunately, such an extended length tip would have to be so long as to render the pipette device to which it was mounted awkward and difficult to use. Also, for any given volume setting of a standard pipette device, such an extended length tip would result in inaccurate volumes of sample liquid being aspirated and then dispensed by the pipette device.

Accordingly, there is a need for an improved pipette tip which when mounted on a mounting shaft of a pipette device will shield the outer surfaces of the pipette device and its tip ejector mechanism from undesired transfer of fluid and potential contamination. The present invention satisfies that need. Also, for micro-volume pipette tips, the present invention provides a pipette tip which is useful in refill packs for pipette tip racks designed to handle pipette tips having volume ranges from 20 to 250 microliters.

SUMMARY OF THE INVENTION

Basically, the present invention comprises a pipette tip characterized by a contamination protector for an outer surface of a pipette device receiving the pipette tip. More particularly, the pipette tip comprises a hollow body having an open end for releaseably receiving a mounting shaft of a pipette device and an orifice at an opposite end for passing a sample fluid into and from the hollow body of the tip in response to operation of the pipette device. The pipette tip further includes a protector extending from the hollow body to protect an outer surface of the pipette device from contamination when the pipette tip is positioned on the mounting shaft of the pipette device.

Preferably the pipette tip includes a hollow distal end portion including the orifice for passing fluid into and out of the distal end portion of the pipette tip and a hollow proximal end portion contiguous with the distal end portion for releaseably receiving the mounting shaft of the pipette device. The protector comprises a projection from the proximal end portion of the pipette tip. The projector laterally separates or spaces the pipette device from a tube or other container which contains or which is to receive the sample fluid to thereby prevent contamination of the pipette device by contact with the tube into which the pipette tip is inserted.

Preferably, the pipette tip further comprises a shoulder extending laterally from the proximal end portion for engaging a lower end of a pipette tip ejection mechanism of the pipette device when it is desired to eject the pipette tip from the mounting shaft of the pipette device.

The projection comprising the protector may take various forms and preferably comprises a collar or sleeve which projects upwardly from the laterally extending shoulder. Alternatively, the protector may comprise one or more arms or a plurality of vertically extending arms which may be connected by one or more lateral connecting rings.

In each embodiment, a protector extends upwardly along an outer surface of the pipette device to which the pipette tip is mounted to laterally separate or space the outer surfaces of the pipette device from sidewalls of the container or tube into which the pipette tip is inserted. The projection prevents the outer surfaces of the pipette device including its pipette tip ejector mechanism from contacting the sidewalls of the container or tube and thereby prevents transfer of liquid or solids from the container or tube to such surfaces. Thus, the projection functions as a contamination protector for outer surfaces of the pipette device to which the pipette tip of the present invention is mounted.

DETAILED DESCRIPTION OF THE INVENTION

Figure 1:
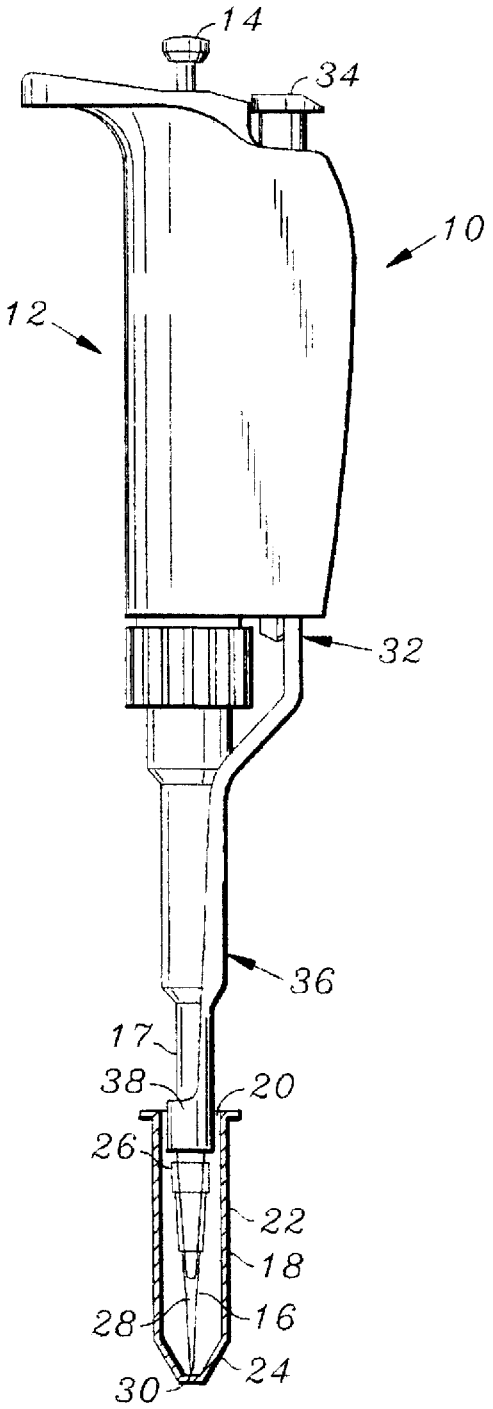
FIG. 1 is a side view of a standard pipette device including a pipette tip ejector mechanism and having a standard pipette tip mounted on a mounting shaft of the pipette device and extending into a vertically extending tube shown as cross-section to illustrate possible areas of contact between outer surfaces of the pipette device and sidewalls of the tube into which the pipette tip is inserted.

The present invention is useful with pipette devices such as the pipette 10 illustrated in FIG. 1. The pipette 10 comprises a hand holdable body 12 and an internal piston mechanism controlled by a push button 14. In operation, a user of the pipette 10 grasps the body 12 in one hand with his or her thumb over the top of the push button 14. By pressing down on the push button 14, the user depresses the piston mechanism within the body 12. Upon release of the push button 14, a spring within the body 12 returns the piston mechanism upward to the position indicated in FIG. 1. During such upward displacement of the piston mechanism, a sample fluid is drawn into a standard pipette tip 16 secured to a pipette tip mounting shaft 17 extending downwardly from a lower portion of the body 12. Then, downward movement of the push button 14 in response to a downward thumb force by the user causes the piston mechanism to move downward within the body 12 to dispense the sample fluid from the tip 16.

As shown in FIG. 1, the pipette tip 16 is positioned within a tube or container 18 for the sample fluid. The tube 18 is shown in cross section in FIG. 1 and comprises an open top 20, vertically extending contiguous sidewalls 22 and a closed bottom 24. To draw fluid samples into the pipette tip 16, the pipette tip is placed vertically in the tube 18 adjacent the closed bottom 24. After the push button 14 has been depressed, it is released and allowed to move upward to aspirate sample fluid from the tube 18 into the pipette tip 16.

In this regard, the pipette tip 16 shown in FIG. 1 is of standard design including an open proximal end portion 26 for tightly receiving the pipette tip mounting shaft 17 to secure the pipette tip 16 on the shaft 17. The pipette tip 16 further includes a hollow conical distal end portion 28 coaxial with and extending downwardly from the open proximal end portion 26 to an orifice 30 at a lower end of the pipette tip 16. Sample fluid aspirated into the pipette tip 16 enters the orifice 30 and is confined in the distal end portion 28 of the pipette tip 16. The sample fluid dispensed from the pipette tip exits the orifice 30 in response to downward movement of the push button 14 driving the piston mechanism downward within the body 12 of the pipette 10.

To allow replacement of the pipette tip 16, the pipette 10 includes a tip ejector mechanism 32 including an actuator button 34 secured to the upper end of an ejector rod-arm 36 terminating in an ejector collar 38. The collar 38 surrounds a lower end of the mounting shaft 17 and has a lower surface spaced slightly from the open proximal end portion 26 of the pipette tip 16. When it is desired to eject the pipette tip 16 from the mounting shaft 17 for replacement by a new pipette, the user of the pipette 10 simply presses downward with his or her thumb on a top of the actuator button 34. Such downward movement is translated as downward movement of the arm 36 and ejector collar 38. The collar 38 then bears on the top edge of the pipette tip 16 to force the pipette tip off the end of the mounting shaft 17.

As illustrated in FIG. 1, the tube 18 includes a relatively narrow open neck portion for receiving the pipette tip 16 and the mounting shaft 17 to which the pipette tip is secured. The tube 18 also receives the ejector collar 38 of the tip ejector mechanism 32 of the pipette 10. It is common in such configurations that a slight lateral movement of the pipette 10 will cause the collar 38 to engage portions of the sidewalls 22 of the tube 18. Such contact between the collar 38 and the sidewalls 22 will transfer fluid and any contaminant on the sidewalls to the collar. Such fluid and contaminants can be transferred to the next tube into which the end of the pipette 10 is inserted to produce undesired cross contamination. To insure against such cross contamination, the outer surface of the pipette 10 including the lower end of the tip ejector mechanism 32 should be cleaned and possibly sterilized between each pipetting operation with the pipette 10. Such cleaning and sterilizing substantially interferes with the efficient laboratory use of pipettes.

The present invention overcomes the problems of undesired contamination of outer surfaces of pipette devices such as the pipette 10, by providing an improved pipette tip including a contamination protector 48. As shown in cross section in FIG. 2, a preferred version of the pipette tip of the present invention is represented by the number 40. As illustrated, the pipette tip 40 includes a tubular proximal end portion 42 dimensioned to longitudinally receive and mate with a lower end of the mounting shaft of a pipette device, such as the mounting shaft 17 of the pipette 10 illustrated in FIG. 1. The proximal end portion 42 is also adapted to receive a filter material or filter plug at a frusto-conical junction 43 with an elongated cone-shaped distal end portion 44 of the pipette tip 40. The distal end portion is contiguous with and extends vertically from the proximal end portion 42 and terminates in an orifice 46 for passing sample fluid into and out of the distal end portion of the pipette tip 40.

In addition to the proximal and distal end portions, the pipette tip 40 in accordance with the present invention includes a protector 48 for outer surfaces of a pipette device to which the pipette tip is mounted in the manner shown in FIG. 1. The protector laterally separates the outer surfaces of the pipette device from inner sidewalls of the container or tube into which the pipette tip 40 is inserted. Specifically, the protector 48 is designed to separate and shield the outer surfaces of the pipette tip ejector mechanism 32 and/or the shaft 17 of the pipette device 10 from contact with sidewalls of a container or tube into which the pipette tip and lower portions of the pipette device are inserted during aspiration and dispensing of sample fluids. As illustrated most clearly in FIG. 2, a preferred version of the protector 48 comprises an upwardly extending collar or sleeve 50 having an upper open end 52 coaxial with an axis 54 of the pipette tip 40. The sleeve 50 is contiguous with the proximal end portion 42 of the pipette tip 40 and preferably connects thereto by an annular laterally extending shoulder 56.

Figure 2:
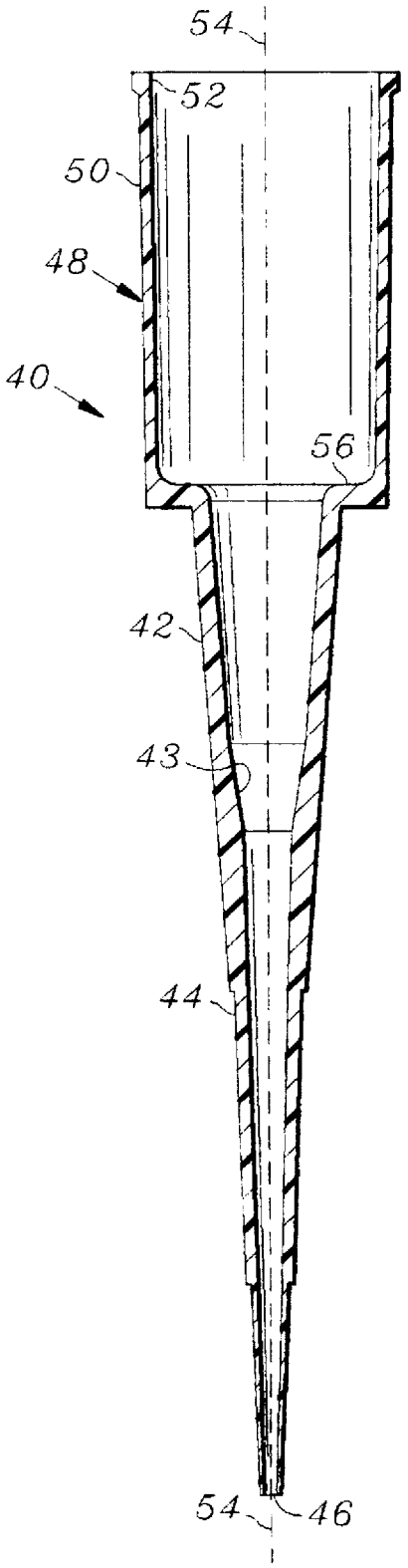
FIG. 2 is a sectional side view of a preferred embodiment of the pipette tip comprising the present invention including a contamination protector for outer surfaces of a pipette device to which the pipette tip is mounted.
Figure 3:
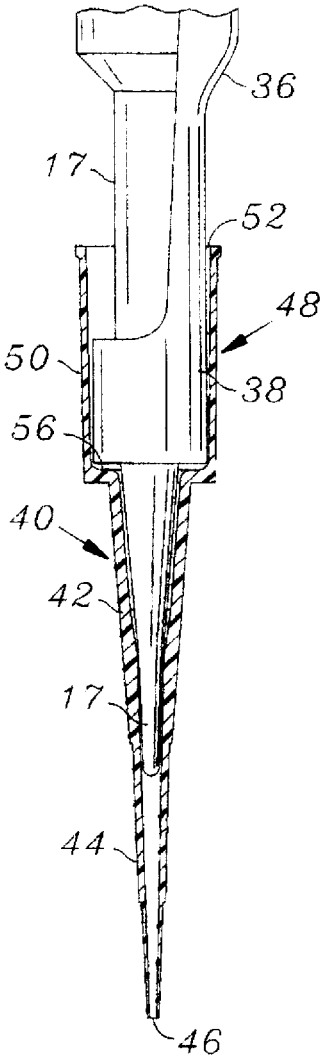
FIG. 3 is a side view of the pipette tip of FIG. 2 shown mounted on a mounting shaft of the pipette device of FIG. 1 illustrating the manner in which the preferred embodiment of the pipette tip of the present invention shields the outer surface including the pipette tip ejector of the pipette tip device.

The pipette tip of FIG. 2 is shown in FIG. 3 mounted on the pipette tip mounting shaft 17 of the pipette 10 as illustrated in FIG. 1. As depicted in FIG. 3, when mounted on the mounting shaft 17, the laterally extending shoulder 56 is spaced slightly from and below a lower edge of the ejector collar 38. Thus positioned, the shoulder 56 is engaged by the collar 38 when it is desired to eject the pipette tip 40 from the mounting shaft 17 of the pipette 10 in the manner previously described.

As illustrated in FIG. 3, the sleeve 50 comprising the protector 48 extends upwardly from the annular shoulder 56 and surrounds and shields the ejector collar 38, a lower portion of the ejector arm 36 and an outer surface of the mounting shaft 17. The sleeve 50 prevents such elements of the pipette 10 from contacting sidewalls of the container or tube into which the pipette tip 40 is inserted for aspiration or dispensing of sample fluids during operation of the associated pipette 10.

Figure 4:
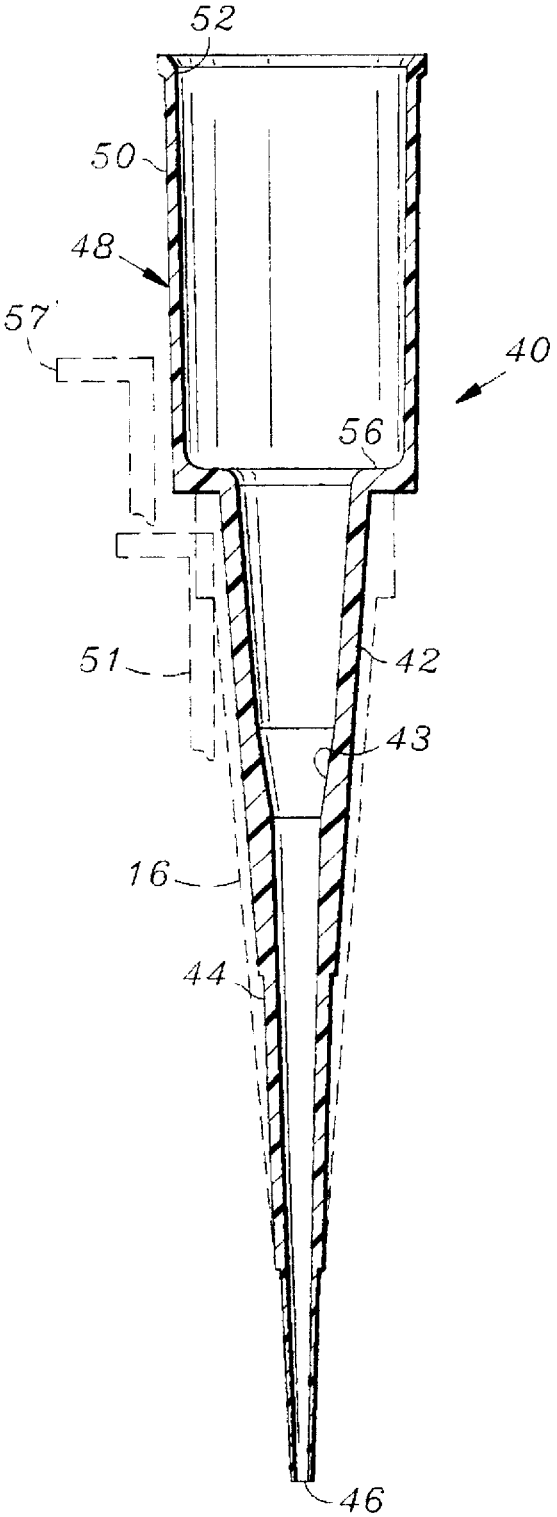
FIG. 4 is an enlarged cross-sectional side view of the pipette tip of FIG. 2 shown overlaying a standard pipette tip illustrated in dashed-line outline and illustrating in phantom outline two microcentrifuge tubes of different volume and the manner in which the protector of the pipette tip of the present invention protects the pipette device to which the pipette tip is mounted from contamination by contact with sidewalls of the microcentrifuge tubes.

Such protection is diagrammatically illustrated in FIG. 4 where upper portions of typical 0.5 microliter and 1.5 or 2.0 microliter microcentrifuge tubes 57 and 57' are depicted in phantom outline below and immediately adjacent to the sleeve 50 comprising the protector 48 of the preferred pipette tip 40 of the present invention. Also depicted in FIG. 4 in dash-line outline is a standard pipette tip 16 overlaying the pipette tip 40 of the present invention. The structural differences between the standard tip and the pipette tip of the present invention are clearly illustrated.

Preferably, the length of the sleeve 50 is substantially the same as the length of the proximal end portion of standard 200 and 250 microliter pipette tips. This enables the pipette tip 40 of the present invention, which is preferably designed to handle very small sample volumes such as 10 to 20 microliters, to be mounted in commercially available pipette tip rack refill packs which are designed currently to handle 200 to 250 microliter pipette tips (see for example United States patents 5,392,914 and 5,441,702). This feature is not present in standard 10 microliter tips as depicted in dash-line outline in FIG. 4.

Figure 5:
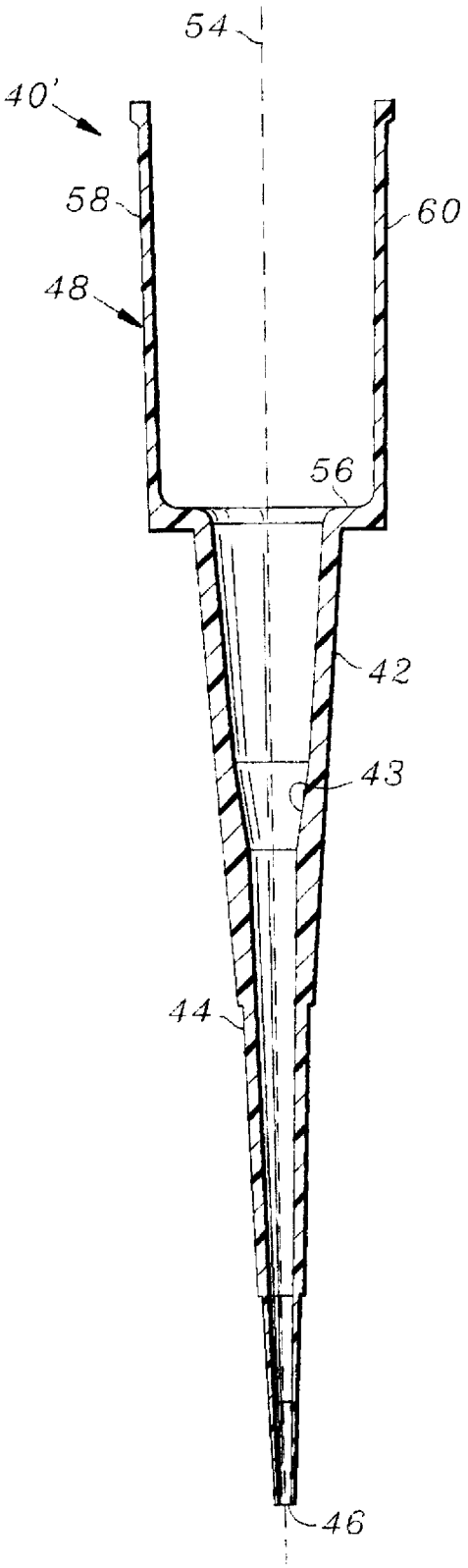
FIGS. 5 and 6 are cross-sectional side views of pipette tips in accordance with the present invention and including alternate forms of contamination protectors.
Figure 6:
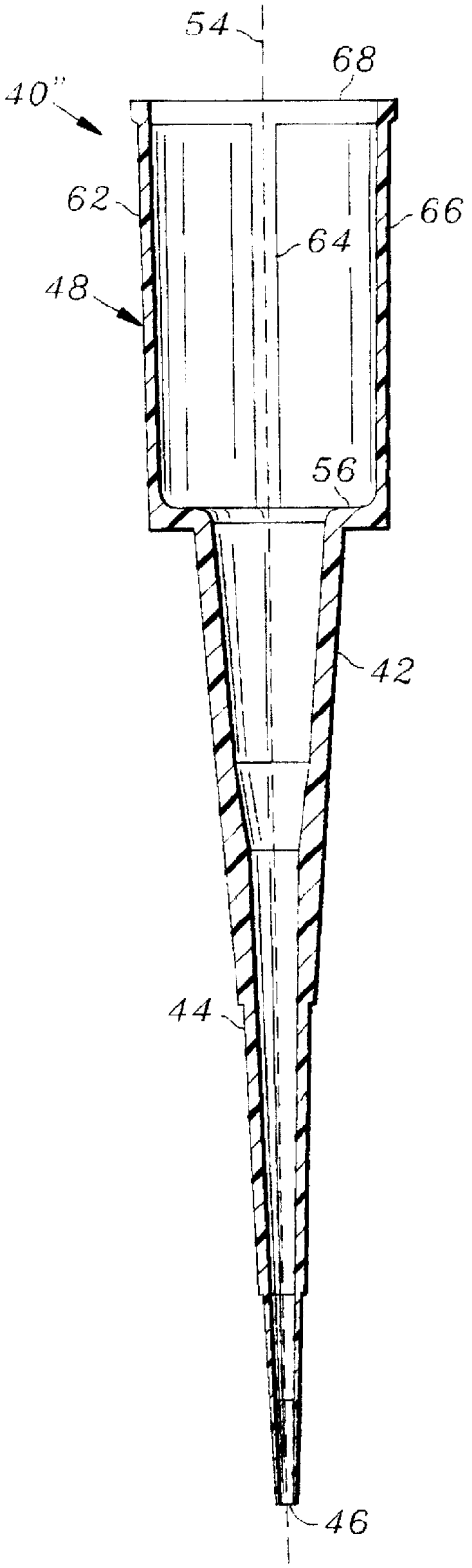

While a collar or sleeve may comprise the preferred form of the protector 48 for the pipette tip 40 of the present invention, alternate forms of protectors may be utilized such as illustrated in FIGS. 5 and 6. As shown in FIG. 5, the protector 48 comprises one or more arms, here a pair of arms 58 and 60 extending upwardly from diametrically opposite portions of the laterally extending shoulder 56 of a pipette tip 40'. The remaining elements of the pipette tip 40' are as depicted for the pipette tip 40 of FIG. 2 including the proximal end portion 42 and elongated distal end portion 44. The arms 58 and 60 function to separate the outer surface of the mounting shaft 17 of a pipette, such as pipette 10, from the inner sidewalls of a container or tube, such as the tube 18 shown in FIG. 1, to thereby prevent fluid transfer and contamination of outer surfaces of the pipette 10 including the pipette tip ejector mechanism 32.

Similar features and benefits are provided by the protector 48 illustrated in FIG. 6 which comprises a plurality of vertically extending arms equally spaced from each other and contiguous with the annular laterally extending shoulder 56 of the pipette tip, here depicted as 40". Three such arms are depicted as 62, 64 and 66 in FIG. 6 and are shown connected at an upper end by an annular ring or cross member 68 which provides supporting structure and stability for the arms 62, 64 and 66. Like the arms 58 and 60 shown in FIG. 5, the arms and ring or rings 68 of FIG. 6 insure that the outer surfaces of the pipette device receiving the pipette tip 40" including its tip ejector mechanism are separated from the inner sidewalls of the containers and tubes into which the pipette tip is inserted. Thus, the arms and ring or rings comprising the protector 48 prevent undesired fluid transfer and contamination of outer surfaces of the pipette device to which the pipette tip 40" is mounted.

From the foregoing, it should be appreciated that while preferred forms of the pipette tip of the present invention have been illustrated and described above, further changes and modifications may be made without departing from the spirit of the present invention. Accordingly, the scope of the present invention is to be limited only by the terms of the following claims.

We claim:

1. A replaceable pipette tip comprising:

a hollow distal end portion including an orifice for passing a sample fluid into and out of the distal end portion of the pipette tip;

a hollow proximal end portion contiguous with the distal end portion for releaseably receiving a mounting shaft of a pipette device;

a pipette tip ejector engaging shoulder extending laterally outward from the proximal end portion to engage a lower end of a pipette tip ejection mechanism of the pipette device when it is desired to eject the pipette tip from the mounting shaft of the pipette device; and a pipette surface contamination protector comprising an upwardly extending projection connected by the shoulder to the proximal end portion for laterally spacing the pipette device from a tube which contains or which is to receive the sample fluid to prevent contamination of an outer surface of the pipette device by contact with the tube into which the pipette tip is inserted.

2. The pipette tip of claim 1 wherein the projection comprises a sleeve.

3. The pipette tip of claims 1 wherein the projection comprises one or more arms.

4. The pipette tip of claim 3 wherein the arms are connected by one or more laterally extending connecting members.

5. The pipette tip of claim 1 wherein the projection is contiguous with and extends upwardly from the shoulder.

6. The pipette tip of claim 5 wherein the projection is a sleeve.

7. The pipette tip of claim 5 wherein the projection comprises one or more arms.

8. The pipette tip of claim 7 wherein the arms are connected by one or more laterally extending connecting members.

* * * * *